US008552887B2

(12) United States Patent
Sherwood et al.

(10) Patent No.: US 8,552,887 B2
(45) Date of Patent: Oct. 8, 2013

(54) DETERMINING AN ELECTRICAL SHORT IN AN AVIATION COMMUNICATION APPARATUS

(75) Inventors: Charles Gregory Sherwood, Olathe, KS (US); Steven G. Foster, Olathe, KS (US)

(73) Assignee: Garmin International, Inc., Olathe, KS (US)

( * ) Notice: Subject to any disclaimer, the term of this patent is extended or adjusted under 35 U.S.C. 154(b) by 154 days.

(21) Appl. No.: 13/357,941

(22) Filed: Jan. 25, 2012

(65) Prior Publication Data

US 2013/0187794 A1 Jul. 25, 2013

(51) Int. Cl.
*G08B 21/00* (2006.01)

(52) U.S. Cl.
USPC ..... 340/945; 381/58

(58) Field of Classification Search
USPC ..... 340/945; 361/42; 381/58, 59, 107; 455/569.1
See application file for complete search history.

(56) References Cited

U.S. PATENT DOCUMENTS

| | | | | |
|---|---|---|---|---|
| 4,941,187 | A | 7/1990 | Slater | 381/86 |
| 5,832,075 | A * | 11/1998 | Gancarcik | 379/377 |
| 6,618,229 | B2 | 9/2003 | Bax | 361/42 |
| 7,030,623 | B1 | 4/2006 | Carpenter | 324/542 |
| 7,305,253 | B2 * | 12/2007 | Snyder et al. | 455/569.1 |
| 7,501,792 | B2 * | 3/2009 | Borjeson et al. | 320/106 |
| 8,107,209 | B2 * | 1/2012 | Simon | 361/119 |
| 2009/0179768 | A1 * | 7/2009 | Sander et al. | 340/825.73 |
| 2010/0232625 | A1 | 9/2010 | Konaka et al. | 381/109 |
| 2012/0328116 | A1 * | 12/2012 | Bidmead et al. | 381/59 |

OTHER PUBLICATIONS

The Bose® Aviation Headset X Owner's Guide, Apr. 5, 1999.

* cited by examiner

*Primary Examiner* — John A Tweel, Jr.
(74) *Attorney, Agent, or Firm* — Samuel M. Korte; Mohammad M. Ali

(57) ABSTRACT

Techniques are described to determine that an electrical short has occurred on a communication channel based on monitoring a power level of the communication channel with respect to a reference power level. In an implementation, the aviation communication apparatus includes a first voltage source that provides a first voltage input to a first communication channel of a stereo jack for a headset, a voltage monitor that monitors a voltage level of the first communication channel with respect to a reference voltage level of the first communication channel and determines that an electrical short has occurred on the first communication channel based on the monitoring. Accordingly, an electrical short indicator may indicate responsive to the voltage monitor determining that the electrical short has occurred.

22 Claims, 4 Drawing Sheets

DETERMINING AN ELECTRICAL SHORT IN AN AVIATION COMMUNICATION APPARATUS

BACKGROUND

Embodiments of the present technology relate to aviation communication devices, including audio panels and headsets, that can be used for communication with control towers, aircraft, co-pilots, and/or passengers within an aircraft. In some cases, an electrical short can occur in a communication channel of an aviation communication device through design and/or through a failure and/or improper wiring.

SUMMARY

Techniques are described to enable an aviation communication apparatus to determine the occurrence of an electrical short on a communication channel based on a monitoring of a voltage level with respect to a reference voltage level. In one or more implementations, the aviation communication apparatus may comprise a first power source that monitors a first power input to a first communication channel of a stereo jack for a headset, a power monitor that monitors a power level of the first communication channel with respect to a reference power level of the first communication channel and determines that an electrical short has occurred on the first communication channel based on the monitoring, and an electrical short indicator to indicate responsive to the power monitor determining that the electrical short has occurred. In implementations, an aviation communication apparatus may comprise a first voltage source that provides a first voltage input to a first communication channel of a stereo jack for a headset, a voltage monitor that monitors a voltage level of the first communication channel with respect to a reference voltage level of the first communication channel and determines that an electrical short has occurred on the first communication channel based on the monitoring, and an electrical short indicator to indicate responsive to the voltage monitor determining that the electrical short has occurred.

The left and right side inputs of aviation equipment are often electrically shorted by design, configuration, or due to improper wiring. Improper wiring may be present in an avionic audio panel, headset, or aircraft. An electrical short determining circuit may alert an aircraft pilot and/or crew of an electrical short causing deteriorated or lost audio communication signals intended to be audibly output to an aircraft pilot and/or crew.

This Summary is provided solely to introduce subject matter in a simplified form that is fully described below in the Detailed Description and the Drawings. Accordingly, the Summary should not be considered to identify or describe essential features nor be used to determine scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears and the remaining digits identify an element or component in the drawing. The use of the same reference numbers in different instances in the description and figures can indicate similar or identical items. For example, reference number 114 may reference element "14" in FIG. 1, and a similar element may be referenced as 214 in FIG. 2.

DETAILED DESCRIPTION

Figure 1:
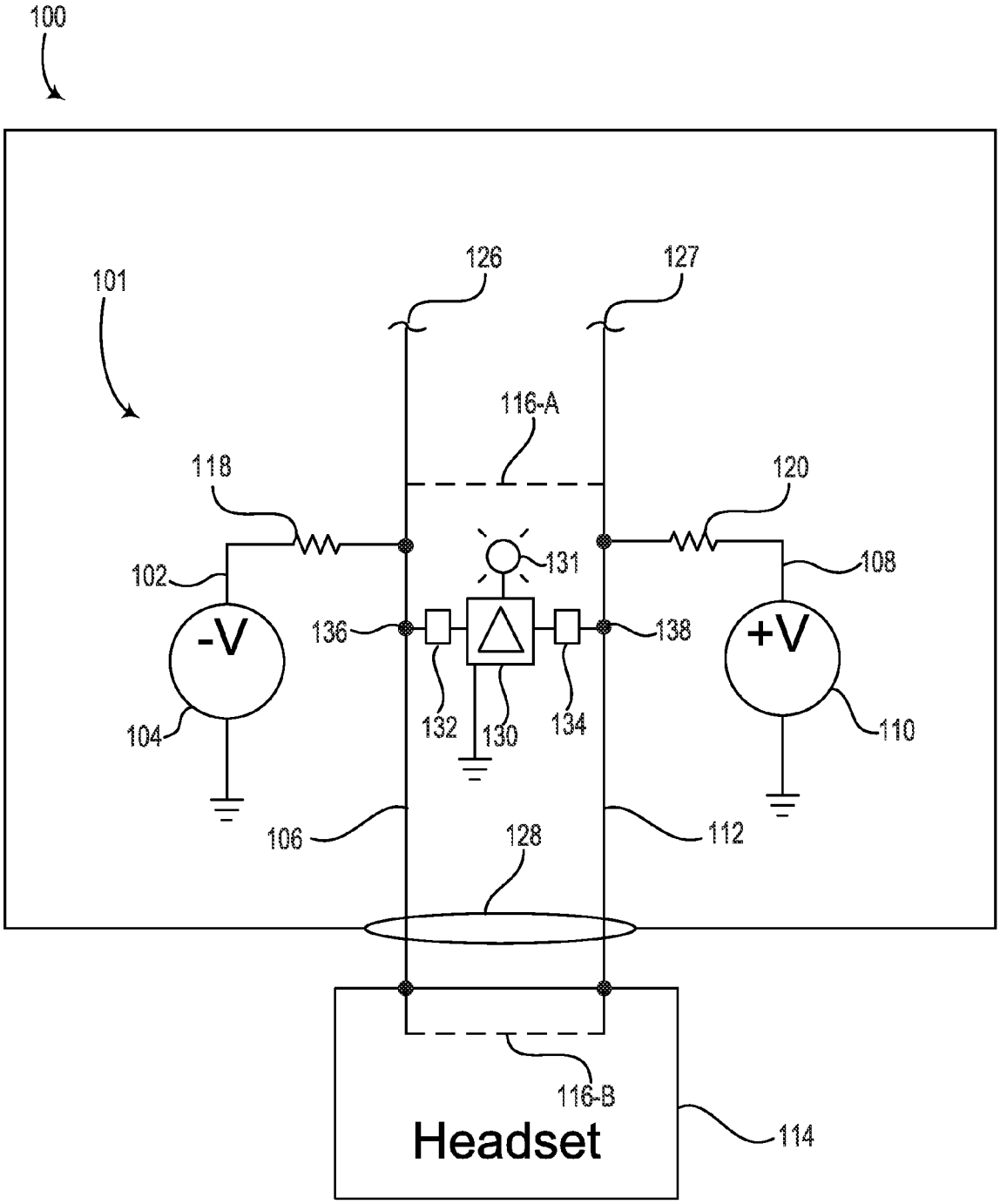
FIG. 1 illustrates an example aviation communication apparatus including an electrical short determining circuit according to an embodiment of the present disclosure.

Methods and apparatus for determining that an electrical short has occurred on the first communication channel based on power level monitoring for an aviation communication apparatus are provided. An example of an apparatus of the present disclosure includes an electrical short determining circuit configured to provide a first voltage input from a first voltage source to a first communication channel, monitor a voltage level of the first communication channel with respect to a reference voltage level of the first communication channel, determine that an electrical short has occurred on the first communication channel based on the monitoring, and indicate the occurrence of a determined electrical short using an electrical short indicator.

As used herein, "a" or "a number of" something can refer to one or more such things. For example, "a number of differences" can refer to one or more differences.

An electrical short on the communication channels of an aviation communication apparatus, such as an audio panel or a headset, can impact the audio signals output to an aircraft pilot and/or crew. An audio panel can include audio inputs, including a plurality of ports, jacks, interfaces, wiring connectors, and/or other inputs for coupling with and receiving audio communications from a plurality of audio sources. The audio panel can include audio outputs, including a plurality of ports, jacks, interfaces, wiring connectors, and/or other outputs for coupling with and outputting audio communications to audio equipment in the aircraft. A headset can include audio inputs, including an audio output from an audio panel, and audio outputs, including a speaker to audibly output an audio signal to an aircraft pilot and/or crew. The headset may include a microphone (MIC) operable to receive audible audio signals from an aircraft pilot and/or crew and output the audio signals to aircraft equipment.

In some embodiments, the audio inputs may include an audio input for receiving audio communications from a first communication (COM1) radio transceiver; an audio input for receiving audio communications from a first microphone (MIC1) associated with the pilot; an audio input for receiving audio communications from a second communication (COM2) radio transceiver; and an audio input for receiving audio communications from a second microphone (MIC2) associated with the co-pilot. Audio communications communicated on COM1 and/or COM2 may provide useful information for the aircraft pilot and crew.

The audio inputs may also include an audio input for receiving audio communications from a first auxiliary (AUX1) radio transceiver; an audio input for receiving audio communications from a second auxiliary (AUX2) radio transceiver; an audio input for receiving information from a first navigation (NAV1) receiver; an audio input for receiving information from a second navigation (NAV2) receiver; and an audio input for receiving information from a telephone (TEL). The audio inputs may further include an audio input for receiving audio communications from a first entertainment radio, media player (e.g., MP3 player), or other similar media source (MUS1). The audio inputs may also include an audio input for receiving audio communications from a second entertainment radio, MP3 player, or other similar media source (MUS2).

In some embodiments, the audio outputs of an audio panel may include a port, jack, interface, or wiring connector communicating audio signals on a left audio channel and right audio channel. The audio outputs may couple with the headset of an aircraft pilot or crew. In some embodiments, the audio outputs of a headset may include a left speaker to audibly output audio signals communicated on a left communication channel and right speaker to audibly output audio signals communicated on a right communication channel. For example, the audio signals output by the headset may include audio signals communicated from the audio output of an audio panel (e.g., left audio jack) on a left communication channel and audio signals communicated from the audio output of an audio panel (e.g., right audio jack) on a right communication channel.

In some embodiments, the aviation communication apparatus, such as a headset or an audio panel, can include selecting circuitry for selecting the audio communications between the audio inputs and the audio outputs. For example, an audio panel can include audio input controls for selecting an audio input and a corresponding audio source(s) and audio output controls for selecting audio outputs and their corresponding audio equipment. The selecting circuitry can be coupled between an audio input and an audio output and can be operable to select and/or route audio communications from one or more of the audio inputs to one or more audio outputs.

An electrical short can impact the functionality of an aviation communication apparatus, such as a headset or an audio panel. For instance, a headset with stereo functionality is operable to output independent audio signals for a left and right communication channel using a left and right speaker of the headset. In some implementations, 3D audio functionality can enable outputting independent audio signals to the left and right communication channels to provide direction, location, and/or spatial information for an audio input and corresponding audio source(s) (e.g., behind, above, and/or below a user of the headset, audio panel, or aircraft). Thus, an aircraft pilot and/or crew may not associate the intended direction, location, and/or spatial information of the stereo audio signals from the respective communication channel of the audio output (e.g., a headset) if an electrical short occurs in the aviation communication apparatus (i.e., audio signals intended to indicate an audio source to the left of the aircraft may be improperly output on the right communication channel instead of the left communication channel), or interconnect wiring.

In some embodiments, upon identifying an electrical short, embodiments of the present disclosure can provide an indication to communicate that an electrical short has occurred and/or disable associated functionality (e.g., 3D audio functionality). In some embodiments, the aviation communication apparatus may compensate for the electrical short to communicate the audio signal received from an audio input to an audio output as intended. For example, the aviation communication apparatus may output the same audio on all available communication channels after the electrical short has been identified to minimize noise and signal conflict (i.e., independent audio signals for a left channel and a right channel are reduced to a single audio signal). As discussed below, the aviation communication apparatus may alert the user of the electrical short or compensate for the electrical short by outputting the received audio signals to a coupled audio output as intended.

An electrical short between communication channels may be caused by a first communication channel physically touching a second communication channel or due to an improper wiring configuration. In some implementations, an electrical short or improper wiring configuration may have directional impact. For instance, the wiring associated with the left communication channel and the right communication channel may be reversed causing audio signals intended to be output on the left communication channel to be improperly output on the right communication channel and signals intended to be output on the right communication channel to be improperly output on the left communication channel. The electrical short or improper wiring configuration may cause degraded signal quality or significant signal loss. Such electrical shorts can be inadvertent or intentional. For example, electrical shorts can occur due to a failure in the wiring of the aviation communication apparatus; as a result of the aviation communication apparatus being improperly wired; by design of the aviation communication apparatus; and/or user configuration of the device.

A mono headset coupled with an audio source outputting stereo audio signals may be designed to electrically ground one communication channel and cause audio signals received on one communication channel to be simultaneously output on both output devices of the headset (e.g., left and right headset speakers). For instance, a mono headset may ground an audio signal received from the right communication channel and output the audio signal received from the left communication channel on both headset outputs. Alternatively, a mono headset may ground an audio signal received from the left communication channel and output the audio signal received from the right communication channel on both headset outputs. The failure in electrical wiring may cause an audio signal intended to be communicated on one communication channel to be lost or improperly communicated to another communication channel, an increased current load on the communication channels, an increased distortion of the audio signals, and/or loss of signal volume, etc. A failure in the electrical wiring of a mono headset, audio panel, or aviation equipment may prevent an audio signal to be audibly output on both channels of the aviation communication apparatus. For example, a wiring error in an audio panel may cause COM1 audio signals intended to be communicated on the left communication channel to be output on the right communication channel, which is electrically grounded in a mono headset coupled to the audio panel, preventing the COM1 audio signals from being output to a user of the mono headset or causing the audio signal to be degraded.

The communication problems that can be directly or indirectly caused by an electrical short include degradation or loss of failsafe audio capability regardless of headset type. Failsafe audio capability can connect one communication channel (e.g., typically the left communication channel) of the aviation headset directly to the COM1 radio audio output and microphone (MIC) input from the aviation headset directly to output hardware ensuring that the audio signals are properly communicated. In some implementations, this communication may be provided through a relay to bypass the audio panel if a fault is detected or upon loss of power to the audio panel. An electrical short may occur for a left communication channel shorted to ground, a right communication channel shorted to ground, or across the left communication channel and the right communication channel. Such an electrical short may cause the audio signal output provided by the failsafe to have increased distortion and/or loss of audio signal in a communication channel, such as the left communication channel communicating audio signals received from a COM1 audio input to an audio output. For example, an audio signal associated with the COM1 audio input may be communicated on a first communication channel to a stereo headset intended to be audibly output on the left output device of the headset (e.g., left speaker of the headset). If an electrical short is occurs from the left communication channel to ground or across the left communication channel and the right communication channel, audio signals intended to be output on the left communication channel may be distorted or lost instead of being communicated on the left communication channel and audibly output as intended (i.e., COM1 audio signals would not be audibly output on the left output device of the headset).

The communication problems that can be directly or indirectly caused by an electrical short include reversal of audio signals received from an audio input causing audio signals received from a left communication channel of an audio input to be outputted on the right communication channel and audio signals received from a right communication channel of an audio input to be outputted on the left communication channel. In some embodiments, an electrical short determining circuit may identify characteristics of the aviation communication apparatus. For instance, the electrical short determining circuit in a headset and/or audio panel may monitor communication channels to determine whether a headset coupled to an audio panel provides stereo or mono output functionality. Alternatively, and/or in addition, the electrical short determining circuit in an audio panel may monitor communication channels to identify whether an audio signal outputted by the aviation communication apparatus was output as intended. Other characteristics of the aviation communication apparatus are identifiable by the electrical short determining circuit.

In some embodiments, voltage levels may be monitored for the left communication channel to ground, the right communication channel to ground, and across the left communication channel and the right communication channel. In some configurations, a non-zero monitored voltage level measured may be taken into consideration to identify an electrical short for a communication channel. Examples of a reference voltage may include a zero-voltage measurement, although examples are not so limited. For instance, a near-zero voltage may be treated as a zero voltage to take minor resistance of the electrical short into account. A near-zero voltage level for the left channel to ground may indicate the occurrence of a short for the left communication channel. In some configurations, an expected non-zero voltage level measured on the aviation communication apparatus may be used to identify an electrical short for a communication channel.

In some embodiments, a negative voltage of a predetermined magnitude may be applied to a first communication channel and a positive voltage of the predetermined magnitude may be applied to the second channel. In some configurations, a near-zero voltage measured on the aviation communication apparatus may be used to identify an electrical short between the first communication channel and second communication channel. For instance, a negative voltage of −28 volts may be applied to the left communication channel and a positive voltage of +28 (i.e., equal magnitude but opposite polarity) may be applied to the right communication channel. In implementations, the magnitude of the applied voltages may vary from the −28 volts and +28 volts. For example, the voltages applied to the communication channels may be −1 volt and +1 volt. An electrical short may be identified as occurring when the voltage measured on the left communication channel, right communication channel, or between the left communication channel and the right communication channel is near-zero. The present invention may be configured to accommodate a headset or audio panel design that provides for a certain magnitude and/or polarity to be applied to the left communication channel or the right communication channel.

An aircraft pilot and/or crew may be visually or audibly alerted of an electrical short. In some embodiments, identification of an electrical short associated with the left communication channel will cause an electrical short indication to be presented to an aircraft pilot and/or crew. In some configurations, the left communication channel may be associated with useful communication information signals, such as audio signals received from the COM1 audio input. A visual or audible alert may allow an aircraft pilot and/or crew to take corrective or appropriate action (e.g., a precautionary step may include notifying other aircraft and air traffic control of the communication loss).

Because an electrical short may be present in any aviation communication apparatus, such as headsets or audio panels, it is advantageous to identify a location of the electrical short in an aviation communication apparatus or aircraft equipment. For instance, an electrical short may be identified on the left communication channel to ground, the right communication channel to ground, and between the left communication channel and the right communication channel. In some implementations, the electrical short determining circuit may identify whether the electrical short has occurred due to the design, improper wiring, or a configuration of an aviation communication apparatus (e.g., headset plug or switch).

Various embodiments of the present disclosure can indicate whether an electrical short occurs on a left channel communication channel, a right channel communication channel, or between communication channels by monitoring voltage levels at one or more circuit positions on an aviation communication apparatus with respect to a reference voltage associated with the associated channel(s).

FIG. 1 illustrates an aviation communication apparatus 100 including an electrical short determining circuit 101 according to an embodiment of the present disclosure. According to one or more embodiments of the present disclosure, the electrical short determining circuit 101 can be configured to provide a first voltage input 102, from a first voltage source 104 to a first communication channel 106 of an output 128, and provide a second voltage input 108, from a second voltage source 110 to a second communication channel 112 of an output 128. In an example, the first voltage input 102 can be provided through a first current limiting device 118 to the first communication channel 106 and the second voltage input 108 can be provided through a second current limiting device 120 to the second communication channel 112. In embodiments, the aviation communication apparatus 100 may be configured to include a first current input providing the functionality of the first voltage input 102, a first current source providing the functionality of the first voltage source 104, a second current source providing the functionality of the second voltage input 108, and a second current source providing the functionality of the second voltage source 110.

A current limiting device may be any device that can limit a magnitude and/or frequency of current passing through the device. Examples of a current limiting device can include a resistor or filter, although examples are not so limited. In some embodiments, multiple current limiting devices can be arranged in series and/or in parallel with one another. In the event of a short, the current limiting devices limit current to safe levels. The current limiting devices 118, 120 can be arranged to provide the functionality of a voltage divider that can be used to adjust a voltage level and/or monitor a voltage level at locations of the aviation communication apparatus 100.

As discussed herein, electrical shorts 116-A and 116-B may occur in the aviation communication apparatus 100 as a result of degraded wiring, improper wiring of the aviation communication apparatus, and/or by design of the aviation communication apparatus 100. An electrical short 116 can occur on a first communication channel 106 to electrical ground or on a right communication channel 112 to ground or an electrical short 116-A can occur between the first communication channel 106 and the second communication channel 112. For example, an improperly wired audio panel or an improperly wired aircraft may contain wiring that has reversed the wiring for a left communication channel 106 and a right communication channel 112 inside the housing of the audio panel or external to the audio panel (e.g., between a radio transceiver and the audio panel). An electrical short 116-B can occur between the first communication channel 106 and the second communication channel 112 within a stereo or mono headset 114. For example, a headset 114 may have improper wiring by design, manufacture, or configuration (e.g., user configuration).

If an electrical short 116 occurs, an audio signal received from an audio input can flow from one communication channel to other communication channel(s). In some embodiments, the electrical short 116 may cause significant or complete signal loss. For example, audio signals communicated on the first communication channel 106 may interfere with the audio signals on the second communication channel 112 if an electrical short occurs between the communication channels. For instance, an audio signal associated with the COM1 audio input may be communicated on a first communication channel 106 to a coupled stereo headset intended to be audibly output on the left output device of the headset (e.g., left speaker of the headset). However, the audio signals are not limited to being received from the COM1 audio input. If an electrical short occurs between the right communication channel 112 and the left communication channel 106, audio signals intended to be output on the left communication channel 106 may be distorted, degraded, or not output. In some embodiments, the aviation communication apparatus 100 may identify high priority audio signals that should be output on a communication channel coupled with a headset and ensure that the identified audio signals are output on a communication channel that is audibly outputting audio to an aircraft pilot and/or crew despite the electrical short 116. For example, audio signals received from a COM1 audio input identified as high priority audio signals that are associated with an electrical short 116 may be output on a communication channel that is audibly outputting audio to an aircraft pilot and/or crew despite the electrical short 116. In some embodiments, identified high priority audio signals (e.g., COM1) may be output on one communication channel audibly outputting audio to an aircraft pilot and/or crew despite the electrical short 116 or output on all available communication channels (e.g., first communication channel 106 and second communication channel 112).

Leads 126, 127 of the first communication channel 106 and the second communication channel 112, respectively, can be coupled to an audio panel and/or transceiver radio, although examples are not so limited. Alternatively, and/or in addition, the first communication channel 106 and the second communication channel 112 can be connected to a headset 114 through an output 128. In an example, the output 128 can be a stereo or mono headphone jack for the headset 114. For example, the first communication channel 106 can communicate with a left side of the headset 114 and the second communication channel 112 can communicate with a right side of the headset 114. In some embodiments, audio signals received from an audio input communicated on the first communication channel 106 may be output through output 128 to a headset coupled thereto that audibly outputs the audio signals on a first output device (e.g., left speaker of headset). Audio signals received from an audio input communicated on the second communication channel 112 may be output through output 128 to a headset coupled thereto that audibly outputs the audio signals on a second output device (e.g., right speaker of headset).

The electrical short determining circuit 101 can be configured to monitor a voltage level of the first communication channel 106 with respect to a reference voltage level of the first communication channel 106, a voltage level of the second communication channel 112 with respect to a reference voltage level of the second communication channel 112, and/or a voltage level between a first communication channel 106 and second communication channel 112 with respect to a reference voltage level between the first communication channel 106 and the second communication channel 112. The magnitude and polarity of the voltage sources can be utilized to provide a desired and/or expected voltage that may be measured at monitoring point(s) in the aviation communication apparatus 100 or aircraft equipment. In the examples discussed herein, the impedance provided by current limiting device 118 is approximately equal to the impedance provided by current limiting device 120 unless stated otherwise. In an implementation, the voltage level across the first communication channel 106 and the second communication channel 112 can be monitored by a voltage monitor, such as a comparator 130 and/or a voltage meter, although examples are not so limited. In embodiments, the direction of flow of electrical currents can be utilized to provide a desired and/or expected electrical current that may be measured at monitoring point(s) in the aviation communication apparatus 100 or aircraft equipment.

The voltage level between the first communication channel 106 and the second communication channel 112 can be monitored across any circuit position 136 on the first communication channel 106 and any circuit position 138 on the second communication channel 112. In some embodiments, the voltage level across the first communication channel 106 and the second communication channel 112 can be monitored at one communication channel or simultaneously at both communication channels, although examples are not so limited.

The first voltage input 102 and the second voltage input 108 can be of the same or opposite polarity. For example, if first voltage input 102 and second voltage input 108 are of opposite polarity, the first voltage input 102 provided to the first communication channel 106 can be negative and the second voltage input 108 provided to the second communication channel 112 can be positive with respect to a ground reference level. Alternatively, the first voltage input 102 provided to the first communication channel 106 can be positive and the second voltage input 108 provided to the second communication channel 112 can be negative.

The magnitude of the first voltage input 102 and the second voltage input 108 can be of a same magnitude or of a different magnitude independent of polarity. For example, if the first voltage input 102 and the second voltage input 108 can be of a same polarity, the first voltage input 102 provided to the first communication channel 106 can be negative and the second voltage input 108 provided to second communication channel 112 can be negative (or both voltage inputs 102, 106 can be positive). Where the first voltage input 102 and the second voltage input 108 are of the same polarity, a magnitude of the first voltage input 102 and the second voltage input 108 can be different so that some current will flow between the first communication channel 106 and second communication channel 112 if an short occurs between the first communication channel 106 and the second communication channel 112.

In some implementations, the first voltage input 102 and second voltage input 108 can have a magnitude in a range of positive or negative 1 to 14 volts. However, the invention is applicable for all voltage ranges and is not to be limited to the voltage ranges provided herein. The first voltage input 102 and the second voltage input 108 can be larger or smaller for aircraft having other voltage level systems.

An electrical short 116 may be identified by monitoring the voltage levels associated with one or more communication channels. If an electrical short 116 occurs, electrical current can flow from one communication channel (e.g. the second communication channel 112) to the other communication channel (e.g., the first communication channel 106) through the electrical short 116. This basic principle can be applied to identify an electrical short 116.

The electrical short determining circuit 101 can be configured to identify an occurrence of an electrical short 116 by monitoring the voltage levels of the first communication channel 106 to electrical ground to identify a change in voltage level with respect to a reference voltage level associated with the first communication channel 106 to electrical ground. Alternatively, and/or in addition, the electrical short determining circuit 101 can be configured to identify an occurrence of an electrical short 116 by monitoring of the voltage levels of the second communication channel 112 to electrical ground to identify a change in voltage level with respect to a reference voltage level associated with the second communication channel 112 to electrical ground.

In some embodiments, equal voltages of opposite polarity may be used to identify a short. For example, proper operation without the occurrence of an electrical short 116 can be confirmed if a small magnitude voltage of negative polarity is applied to the first communication channel 106 and an approximately equal magnitude voltage of opposite polarity is applied to the second communication channel 112 and the voltage level across the first communication channel 106 and second communication channel 112 is monitored as being nearly equal to the sum of the applied first voltage source 104 and second voltage source 110. For instance, the first voltage input 102 can be applied to the first current limiting device 118 to maintain a first communication channel 106 voltage of −1.0 volt and the second voltage input 108 can be applied to a second current limiting device 120, which provides an impedance approximately equal to the impedance provided by current limiting device 118, to maintain a second communication channel 112 voltage of 1.0 volt. In embodiments monitoring electrical currents to identify proper operation of an electrical short, a first current input can be applied to the first current limiting device 118 to maintain an electrical current of 1 milliampere (mA) flowing in a first direction along the first communication channel 106 and a second current input can be applied to a second current limiting device 120, which provides an impedance approximately equal to the impedance provided by current limiting device 118, to maintain an electrical current of 1 milliampere (mA) flowing in a second direction along the second communication channel 112.

When an electrical short has not occurred, the voltage level of first communication channel 106 to electrical ground is of −1.0 volt and the voltage level of the second communication channel 112 to electrical ground is of 1.0 volt can be maintained approximately equal to the respective reference voltages. Alternatively, any other voltage level can be used as a reference voltage to confirm proper operation of aviation communication apparatus 100 and aircraft equipment without a short or improper wiring.

In some implementations, the voltage level across first communication channel 106 and second communication channel 112 can be measured and/or monitored. Proper circuit operation without an electrical short 116 may be confirmed by a voltage nearly equal to the difference of the voltage sources 104 and 110 measured across first communication channel 106 and second communication channel 112 having a first voltage source 104 and a second voltage source 110 of equal voltage magnitude and opposite polarity and current limiting devices 118, 120 of substantially equivalent impedance.

When an electrical short 116 has occurred, electrical current can flow from one communication channel (e.g., a first voltage input 102 applied from a first voltage source 104 to a first communication channel 106) to another communication channel (e.g., a second voltage input 108 applied from a second voltage source 110, to a second communication channel 112) through the electrical short 116. Therefore, if the communication channels have voltage of the same magnitude and opposite polarity applied, the voltage level across the first communication channel 106 and the second communication channel 112 is approximately 0 volts and an indication that an electrical short 116 may have occurred between the first communication channel 106 and the second communication channel 112. The voltage level of first communication channel 106 to electrical ground and/or second communication channel 112 to electrical ground is no longer approximately equal to the respective reference voltages. For example, if the voltage level of first communication channel 106 to electrical ground is of −1.0 volt and the voltage level of the second communication channel 112 to electrical ground is of 1.0 volt during operation without an electrical short 116, the electrical current flow caused by an electrical short 116 may cause the voltage of the first communication channel 106 to increase from the first communication channel 106 reference voltage of −1.0 volt to approximately 0 volts and the voltage of second communication channel 112 to decrease from the second communication channel 112 reference voltage of 1.0 volt to approximately 0 volts. In embodiments monitoring electrical currents to identify an electrical short, if the communication channels have electrical current of the same magnitude and opposite direction applied, the electrical current flow across the first communication channel 106 and the second communication channel 112 is approximately equal to a current source and an indication that an electrical short 116 may have occurred between the first communication channel 106 and the second communication channel 112. In embodiments, if there is no electrical short 116 between the first communication channel 106 and the second communication channel 112, approximately no current flows across the first communication channel 106 and the second communication channel 112.

In an alternative example, the first voltage input 102 and the second voltage input 108 are of a different magnitude and the same polarity. For instance, the first voltage input 102 can be applied to the first current limiting device 118 to maintain a voltage level associated with the first communication channel 106 to electrical ground of 2.0 volts and the second voltage input 108 can be applied to the second current limiting device 120 to maintain a voltage level associated with the second communication channel 112 to electrical ground of 1.0 volt. In such an example, the first communication channel 106 to electrical ground voltage level of 2.0 volts and the second communication channel 112 to electrical ground voltage level of 1.0 volt can serve as reference voltage levels used to identify proper operation without an electrical short 116 or improper circuit operation. If an electrical short 116 occurs, electrical current can flow from the first communication channel 106, which has a reference voltage of 2.0 volts, to the second communication channel 112 voltage, which has a reference voltage of 1.0 volt. This electrical current flow caused by an electrical short 116 can cause the voltage level of the first communication channel 106 to electrical ground to decrease from the reference voltage level of 2.0 volts to 1.5 volts and the voltage of the second communication channel 112 to electrical ground to increase from the second communication channel 112 reference voltage of 1.0 volt to 1.5 volts. Upon occurrence of the electrical short 116, the voltage of the first communication channel 106 and/or the second communication channel 112 can change (e.g., increase and/or decrease depending on the magnitude and polarity of the voltage applied to each respective communication channel). Thus, detection of voltage level changes can be used to identify an electrical short 116.

The aviation communication apparatus 100 may require no electrical current to flow across the first communication channel 106 and the second communication channel 112 during proper operation without an electrical short 116. In an example, the first voltage input 102 from a first voltage source 104 can be applied to the first current limiting device 118 to maintain a desired voltage level of −1.0 volt for the first communication channel 106 and the second voltage input 108 from a second voltage source 110 can be applied to a second current limiting device 120 to maintain a desired voltage level of 1.0 volt for the second communication channel 112 voltage. When no electrical short 116 occurs, the first communication channel 106 voltage level of −1.0 volt and the second communication channel voltage level of 1.0 volt can be maintained because no electrical current flows between the first communication channel 106 and the second communication channel 112 (i.e., approximately an open circuit).

In some configurations, a modulation of the voltage of the first communication channel 106 and/or second communication channel 112 can occur as a result of how much current each side of the headset 114 is drawing. Current draw associated with the headset 114 can change, for example, due to electrical signals carrying audio signals passing through the first communication channel 106 and/or second communication channel 112 to device outputs of the headset 114 (e.g., left and right speakers of the headset 114). For example, a high magnitude audio signal audibly output through a first device output of the headset 114 can cause more current to be drawn over the first communication channel 106 than current drawn over the second communication channel 112 in response to a lower magnitude audio output through the second device output of the headset 114. Thus, the voltage on the first communication channel 106 and/or the second communication channel 112 can modulate as a result of normal operation of the headset 114 and can trigger a false indication of an electrical short.

To account for anticipated fluctuations in the current drawn by the headset 114 and other variations in circuit operation, a flexible tolerance variation may be established in the baseline for normal operation of the electrical determining circuit 101 without an electrical short 116. For example, if 2.0 volts serves as a reference voltage level for normal operation of a communication channel of the electrical determining circuit 101, a tolerance parameter may accommodate for modulation of audio signals on the communication channels (e.g., 0.1 volts) to avoid a false indication of an electrical short 116. For instance, if the voltage level of the first communication channel 106 varies by ±0.05 volts due to the communication of an audio signal or circuit operation without an electrical short 116, an electrical short will not be indicated. Other voltage margins can be used.

In some implementations, the electrical short determining circuit 101 may include a comparator 130 configured to measure and/or monitor the voltage level across the first communication channel 106 by measuring the voltage level from any circuit position 136 on the first communication channel 106 to electrical ground, any circuit position 138 on the second communication channel 112 to electrical ground, or across any circuit position 136 on the first communication channel 106 and any circuit position 138 on the second communication channel 112. If the voltage level measured across the first communication channel 106 and the second communication channel 112 changes by a predetermined voltage difference, the comparator 130 may identify the occurrence of an electrical short 116 between the first communication channel 106 and the second communication channel 112.

To minimize audio signals from interfering with the comparator 130 of the electrical short determining circuit 101, one or more low-pass filters 132, 134 may be included in the electrical short determining circuit 101. The interference may improperly trigger the comparator 130. In some embodiments, one or more filters may be used to prevent the audio signals from triggering the comparator 130. For instance, a first low-pass filter 132 can be coupled to the first communication channel 106 and the comparator 130. Similarly, a second low-pass filter 134 can be coupled to the second communication channel 112 and the comparator 130. Low-pass filters 132, 134 may allow a low-frequency signal to pass through the filters and reduce portions of the signal with a frequency higher than a cutoff frequency of the low-pass filters 132, 134. For example, a high-frequency audio transmission signal may be filtered by the low-pass filters 132, 134 so as to not interfere with the comparator 130.

The electrical short determining circuit 101 can be configured to include an indicator 131 to provide an indication that an electrical short 116 may have occurred, for example, via a production device (e.g., light, LED, alarm, etc). In an example, the indication can include a visual and/or audible indication. The visual indication can be provided on a display associated with the instrument panel and/or audio panel, such as the use of a light indicator 131 (e.g., light emitting diode (LED)) controlled by the electrical short determining circuit 101. Alternatively, and/or in addition, a speaker may be associated with the aviation communication apparatus 100 to provide an audible indication (e.g., alarm) that an electrical short 116 has occurred (e.g., speaker on audio panel or part of headset 114). In some configurations, the indication can be latching, so as to indicate intermittent short circuits.

Alternatively, and/or in addition, the electrical short determining circuit 101 can be configured to determine whether a headset 114 is coupled to the audio panel, whether it requires the audio input to be communicated from output 128 on one communication channel (mono headset) or two communication channels (stereo headset), and whether the headset includes functionality to electrically short 116 the wiring of the headset, which may electrically short 116-B one or both of the audio signals. In some implementations, the electrical short determining circuit 101 may determine the characteristics of the headset by monitoring the voltage levels of the first communication channel 106, the second communication channel 112, or across the first communication channel 106 and the second communication channel 112 (e.g., circuit positions 136, 138). The headset 114 can have an inherent resistance (i.e., impedance), for example, in a range of 150 ohms to 600 ohms, although examples are not so limited. For instance, when the headset 114 with a resistance of 150 ohms is coupled to the first communication channel 106 and the second communication channel 112 of the audio panel, the headset 114 has an effect of adding a resistor with a resistance of 150 ohms to the first communication channel 106 and/or the second communication channel 112. As a result, the resulting voltage change caused by headset 114 may provide an indication that the headset 114 is coupled with the audio panel (e.g., plugged into the stereo jack).

In some embodiments, the electrical short determining circuit 101 may be functionally separated from other portions of the aviation communication apparatus 100 or associated avionic system(s). For example, one or more filters (e.g., high pass filter, DC block, etc.) may be included on leads 126, 127 of the first communication channel 106 and the second communication channel 112, respectively, to prevent undesired signals from interfering with the electrical short determining circuit 101 or headset 114 or signals from the electrical short determining circuit 101 or headset 114 interfering with the other portions of the aviation communication apparatus 100 or associated avionic system(s).

In some embodiments, the first voltage source 104 and/or second voltage source 110 may be an audio input that provides audio signals to the first communication channel 106 and the second communication channel 112 of the audio panel. For example, voltage sources 104, 110 may provide audio signals to communication channels 106, 112 in addition to or in place of providing the electrical voltage input discussed herein. In some embodiments, first current limiting device 118 and second current limiting device 120 may be configured to enable audio signals provided by the first voltage source 104 and/or second voltage source 110 to pass through to the first communication channel 106 and the second communication channel 112 without signal attenuation. In some implementations, current limiting devices 118, 120 may include signal bypass components (e.g., filters) enabling audio signals provided by voltage sources 104, 110 to pass through to communication channels 106, 112, respectively. For example, the signal bypass components may allow signals to pass through based on an acceptable frequency range and/or signal magnitude. It is to be understood that voltage sources 104, 110 may provide audio signals to the first communication channel 106 and the second communication channel 112, respectively, in addition to providing other functionality described herein.

Figure 2:
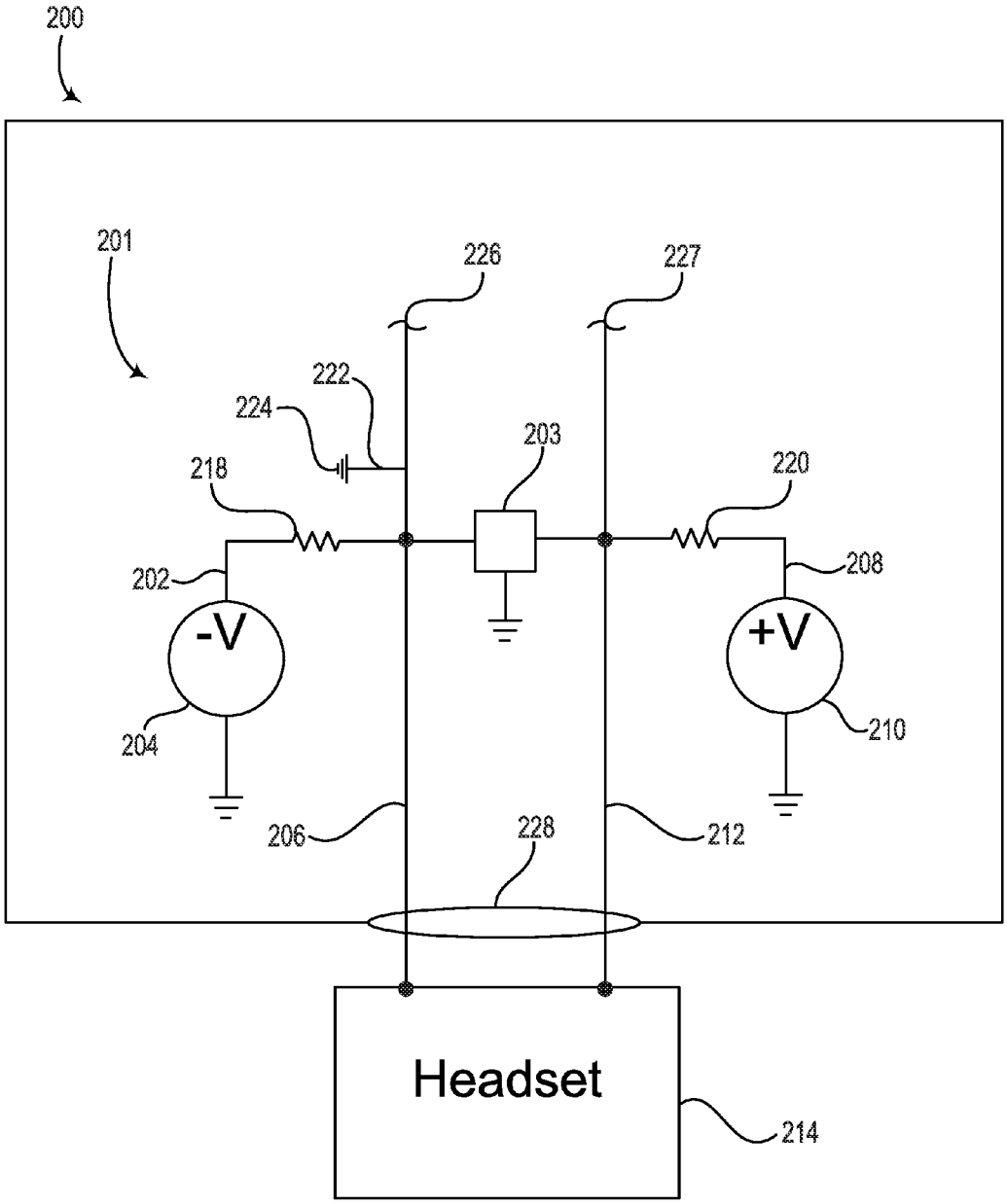
FIG. 2 illustrates an example aviation communication apparatus including an electrical short determining circuit according to an embodiment of the present disclosure.

FIG. 2 illustrates an aviation communication apparatus 200 including an electrical short determining circuit 201 according to an embodiment of the present disclosure. The aviation communication apparatus 200 can be a panel mounted aviation audio panel or headset. In various embodiments of the present disclosure, the electrical short determining circuit 201 can be located, for example, within the panel mounted aviation audio panel 200 (e.g., an audio panel), the headset 214, and/or elsewhere within an aircraft. Alternatively, and/or in addition, the aviation communication apparatus 200 can be a portable aviation audio panel or radio and the electrical short determining circuit 201 can be located within the portable aviation audio panel.

According to one or more embodiments of the present disclosure, the electrical short determining circuit 201 can include a first voltage source 204 that provides a first voltage input 202 to a left communication channel 206 of a stereo jack 228 for a headset 214, and a second voltage source 210 that provides a second voltage input 208 to a right communication channel 212 of the stereo jack 228 coupled with the headset 214. In an example, the first voltage input 202 and the second voltage input 208 can be of a first and second magnitude and a first and second polarity. For instance, the first and second magnitude can be the same or different and the first and second polarity can be the same or different. The headset 214 may be a mono headset requiring a single audio input source or a stereo headset requiring an audio input source providing unique audio signals for the left and right speakers associated with headset 214. In embodiments, the electrical short determining circuit 201 may be configured to include current sources to provide this functionally.

In some embodiments, the first voltage source 204 can be connected to a first side of a first current limiting device 218 (e.g., resistor) and the second side of the first current limiting device 218 can be connected to the left communication channel 206. The second voltage source 210 can be connected to a first side of a second current limiting device 220 and the second side of the second current limiting device 220 can be connected to the right communication channel 212. As such, the first voltage input 202 can be provided through the first current limiting device 218 to the left communication channel 206 and the second voltage input 208 can be provided through the second current limiting device 220 to the right communication channel 212. The first current limiting device 218 and the second current limiting device 220 can be of the same resistance or different resistance.

The electrical short determining circuit 201 can include a voltage monitor 203 that monitors a voltage level of the left communication channel 206 to electrical ground with respect to a reference voltage level of the left communication channel 206 to electrical ground and determines that an electrical short has occurred on the left communication channel 206. Alternatively, and/or in addition, the electrical short determining circuit 201 can include a voltage monitor 203 that monitors a voltage level of the right communication channel 212 to electrical ground with respect to a reference voltage level of the right communication channel 212 to electrical ground and determines that an electrical short has occurred on the right communication channel 212. In an example, the electrical short can include electrical short 222 to electrical ground 224. The electrical short determining circuit 201 can be configured to identify or determine that the electrical short 222 to electrical ground 224 has occurred on the left communication channel 206 when a magnitude of the voltage of the left communication channel 206 drops below a reference voltage level for the left communication channel (e.g., 1 volt).

In various embodiments, the electrical short determining circuit 201 can be configured to identify a directional impact of an electrical short (e.g., an electrical short between the right communication channel 212 and the left communication channel 206 causing audio signals to be distorted, degraded, or not output (i.e., signal lost without being audibly outputted by a headset)).

The electrical short 222 to electrical ground 224 can occur from the left communication channel 206 to electrical ground 224 and/or the electrical short 222 can occur from the right communication channel 212 to electrical ground 224. In an example where the electrical short 222 to electrical ground 224 occurs from the left communication channel 206 to electrical ground 224, some and/or all of the electrical current provided from voltage source 204 can pass to electrical ground 224. This can affect the voltage of the left communication channel 206 with respect to the reference voltage of the left communication channel 206. For example, if the first voltage input 202 is applied to the first current limiting device 218 to maintain the left communication channel 206 to electrical ground 224 voltage level of −1.0 volt and the second voltage 210 is applied to the second current limiting device 220 to maintain the right communication channel 212 to electrical ground 224 voltage level of 1.0 volt and the electrical short 222 occurs from the left communication channel 206 to electrical ground 224, the voltage level of the left communication channel 206 can change to approximately 0 volts. As such, a visual or audible indication of the electrical short 222 can be provided by a production device of an indicator 131 responsive to the voltage monitor 203 determining that the electrical short 222 has occurred (e.g., the voltage level has changed (e.g., decreased) with respect to a reference voltage for the left communication channel 206).

In some embodiments, the voltage monitor 203 can monitor the voltage level of the left communication channel 206 with respect to a reference voltage level between the left communication channel 206 and the right communication channel 212. The voltage monitor 203 can determine or identify that the electrical short 222 to electrical ground 224 has occurred on the left communication channel 206 based on the monitoring of the voltage of the left communication channel 206 with respect to a reference voltage level between the left communication channel 206 and second communication channel 212.

In some instances, the electrical short 222 to electrical ground 224 may not be an ideal electrical short, where all current flowing from the first voltage source 204 is drawn to electrical ground 224, because the portion associated with the electrical short 222 may have some resistance. In such instances, for example, the voltage level of the left communication channel 206 can drop to a non-zero value approximately equal to 0 volts (e.g., 0.1 volt). Based on the monitoring of changes in voltage, the electrical short 222 to electrical ground 224 can be determined even though the electrical short 222 includes some resistance and the voltage of the communication channel is not at an absolute 0 volts.

Figure 3:
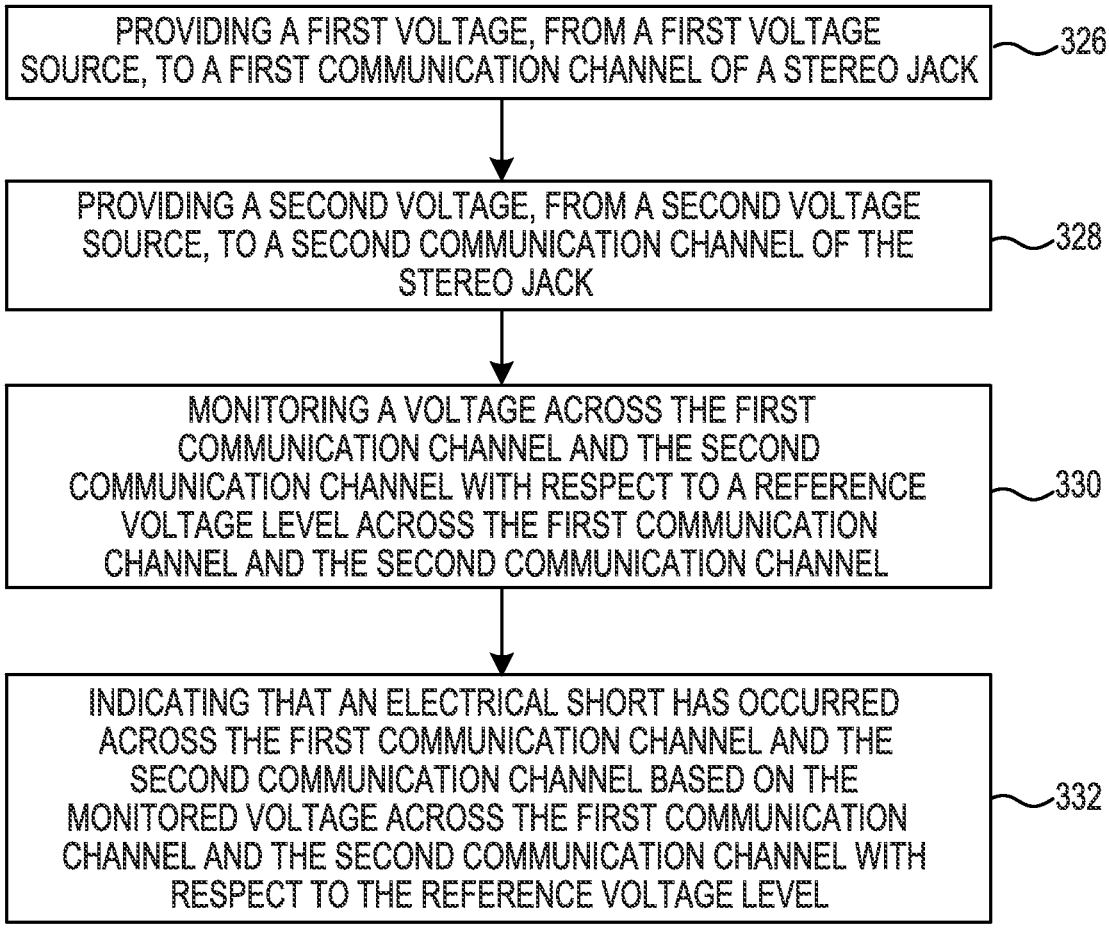
FIG. 3 is a flow chart illustrating an example of a method for indicating an electrical short for an aviation communication apparatus according to an embodiment of the present disclosure.

FIG. 3 is a flow chart illustrating an example of a method for identifying and/or indicating an electrical short between communication channels for an aviation communication apparatus according to an embodiment of the present disclosure. As shown at 326, the method can include providing a first voltage input from a first voltage source to a first communication channel of a stereo jack. The method can include, as shown at 328, providing a second voltage input from a second voltage source to a second communication channel of the stereo jack.

The method can include monitoring a voltage across the first communication channel and the second communication channel with respect to a reference voltage level across the first communication channel and the second communication channel, as shown at 330. The method, as shown at 332, can include indicating that an electrical short has occurred between the first communication channel and the second communication channel based on a difference of the voltage across the first communication channel and the second communication channel with respect to the reference voltage level across the first communication channel and the second communication channel. The method may include applying a voltage to the first communication channel and an approximately equal magnitude voltage of opposite polarity to the second communication channel and determining whether the voltage level across the first communication channel and second communication channel is monitored as being nearly equal to the sum of the applied first voltage source and second voltage source.

Figure 4:
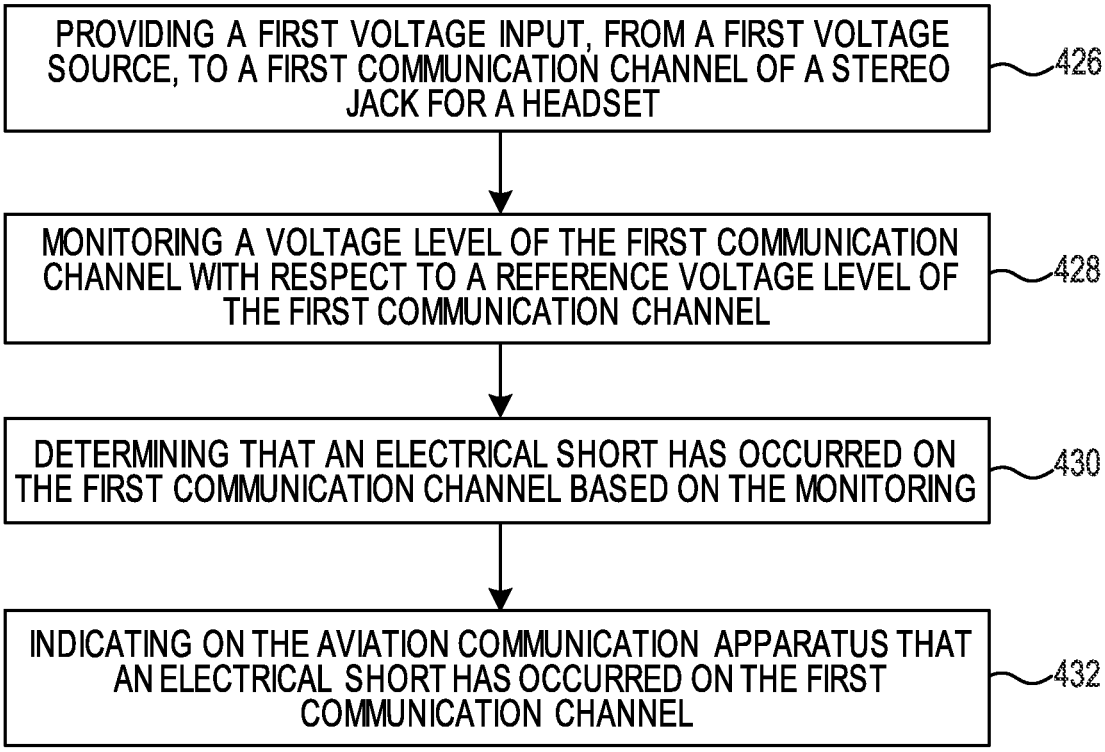
FIG. 4 is a flow chart illustrating an example of a method for indicating an electrical short for an aviation communication apparatus according to an embodiment of the present disclosure.

FIG. 4 is a flow chart illustrating an example of a method for identifying and/or indicating an electrical short between communication channels for an aviation communication apparatus according to an embodiment of the present disclosure. As shown at 426, the method can include providing a first voltage input, from a first voltage source, to a first communication channel of a stereo jack for a headset. The method can include, as shown at 428, monitoring a voltage level of the first communication channel with respect to a reference voltage level of the first communication channel.

The method can include determining that an electrical short has occurred on the first communication channel based on the monitoring, as shown at 430. The method, as shown at 432, indicating on the aviation communication apparatus that an electrical short has occurred on the first communication channel.

In various embodiments, the method can include indicating that a headset plugged into the stereo jack is pre-wired as a mono headset (e.g., with communication channels shorted together), or has been switched to a mono setting (e.g., with communication channels shorted together) by monitoring the stereo jack. The method may include determining that an electrical short has occurred from a first communication channel to electrical ground, from a second communication channel to electrical ground, or between a first communication channel and a second communication channel in an audio panel, headset, or aircraft equipment by monitoring voltage levels with respect to reference voltage levels. Alternatively, and/or in addition, the method can include indicating when a headset has been plugged into the stereo jack using a mono plug, rather than a stereo plug. Mono plugs, may be designed to have an electrical short from a first communication channel to electrical ground, a second communication channel to electrical ground, or between the first communication channel and second communication channel.

When a headset is a mono headset, switched to a mono setting, or uses a mono plug, the first communication channel and the second communication channel may be shorted together. This can affect the voltage level across the first communication channel and the second communication channel in a same way as previously described for an unintended short there between. For example, if −1.0 volt are provided to the first communication channel and 1.0 volt are provided to the second communication channel and the electrical short occurs between the first communication channel and the second communication channel, the voltage across the first communication channel and the second communication channel can change to approximately 0 volts. If the electrical short is limited to the left channel or the right channel, the voltage associated with the respective channel will change to approximately 0 volts.

Based on the monitoring of the change in voltage, the electrical short can be determined and indicated to aircraft pilot and/or crew. For example, the method can include indicating that the electrical short has occurred on the left channel, on the right channel, or between the first communication channel and the second communication channel enabling the aircraft pilot and/or crew to take corrective or appropriate action.

The above-described embodiments of the aviation communication apparatus provide numerous advantages. For example, an electrical short may be identified by using voltage sources. Although the invention has been described in language specific to structural features and/or methodological acts, it is to be understood that the functionality described herein may be accomplished by using current sources or other electrical components. Further, it is to be understood that the invention defined in the appended claims is not necessarily limited to the specific features or acts described. Rather, the specific features and acts are disclosed as example forms of implementing the claimed invention. Although the technology has been described with reference to the embodiments illustrated in the attached drawing figures, equivalents may be employed and substitutions made herein without departing from the scope of the technology as recited in the claims.

The above specification, examples and data provide a description of the method and apparatus of the present disclosure. Since many examples can be made without departing from the spirit and scope of the system and method of the present disclosure, this specification merely sets forth some of the many possible embodiment configurations and implementations. Although specific examples have been illustrated and described herein, those of ordinary skill in the art will appreciate that an arrangement calculated to achieve the same results can be substituted for the specific examples shown. It is to be understood that the above description has been made in an illustrative fashion, and not a restrictive one. Therefore, the scope of one or more examples of the present disclosure should be determined with reference to the appended claims, along with the full range of equivalents to which such claims are entitled.

In the foregoing discussion of the present disclosure, reference is made to the accompanying drawings that form a part hereof, and in which is shown by way of illustration how examples of the disclosure may be practiced. The figures attempt to follow a numbering convention in which the first digit or digits correspond to the drawing figure number and the remaining digits identify an element or component in the drawing. Similar elements or components between different figures may be identified by the use of similar digits. Elements shown in the various figures herein can be added, exchanged, and/or eliminated so as to provide a number of additional examples of the present disclosure. In addition, the proportion and the relative scale of the elements provided in the figures should not be taken in a limiting sense.

What is claimed:

1. An aviation communication apparatus operable to detect an electrical short, the apparatus comprising:

a first power source that provides a first power input to a first communication channel of a stereo jack for a headset;

a power monitor that monitors a power level of the first communication channel with respect to a reference power level of the first communication channel and determines that an electrical short has occurred on the first communication channel based on the monitoring; and an electrical short indicator to indicate responsive to the power monitor determining that the electrical short has occurred.

2. The aviation communication apparatus of claim 1, wherein the first power source is a voltage source, the first power input is a first voltage input, and the power monitor is a voltage monitor.

3. The aviation communication apparatus of claim 2, wherein the voltage monitor determines that an electrical short has occurred on the first communication channel by identifying when a magnitude of the voltage level of the first communication channel is less than the reference voltage level of the first communication channel.

4. The aviation communication apparatus of claim 3, wherein the reference voltage level of the first communication channel is approximately 1 volt.

5. The aviation communication apparatus of claim 2, wherein the voltage monitor monitors a voltage level across the first communication channel and electrical ground.

6. The aviation communication apparatus of claim 2, further comprising a second voltage source that provides a second voltage input to a second communication channel, wherein the voltage monitor monitors a voltage level of the second communication channel with respect to a reference voltage level of the second communication channel.

7. The aviation communication apparatus of claim 6, wherein the voltage monitor monitors a voltage level between the first communication channel and the second communication channel with respect to a reference voltage level across the first communication channel and the second communication channel.

8. The aviation communication apparatus of claim 6, wherein the first voltage input provided by the first voltage source passes through a first current limiting device and the second voltage input provided by the second voltage source passes through a second current limiting device, wherein the first current limiting device and the second current limiting device are resistors of an equal resistance.

9. The aviation communication apparatus of claim 7, wherein the first communication channel is a left communication channel of the stereo jack and the second communication channel is a right communication channel of the stereo jack.

10. The aviation communication apparatus of claim 9, wherein the voltage monitor determines that an electrical short has occurred on the left communication channel based on the monitoring of voltage level across the left communication channel and the right communication channel.

11. An aviation communication apparatus for use in an airplane, the apparatus comprising:

an audio signal receiver operable to receive audio signals from an audio source;

a stereo jack operable to couple with a headset, wherein the received audio signals are output to the headset on a first communication channel;

an electrical short indicator operable to provide an indication of an electrical short on the first communication channel; and an electrical short determining circuit coupled with the audio signal receiver, the stereo jack, and the electrical short indicator, the electrical short determining circuit configured to:

provide a first voltage input, from a first voltage source, to the first communication channel, identify an electrical short on the first communication channel by comparing a voltage level of the first communication channel with respect to a reference voltage level of the first communication channel, and indicate the occurrence of an identified electrical short using the electrical short indicator.

12. The aviation communication apparatus of claim 11, wherein the electrical short indicator is operable to provide at least one of a visual and audible indication to indicate the occurrence of an identified electrical short.

13. The aviation communication apparatus of claim 11, wherein the first communication channel is a left communication channel of the stereo jack.

14. The aviation communication apparatus of claim 11, wherein the voltage monitor monitors a voltage level across the first communication channel and electrical ground.

15. The aviation communication apparatus of claim 11, further comprising a second voltage source that provides a second voltage input to a second communication channel, wherein received audio signals are output to the headset on the first communication channel and the second communication channel.

16. The aviation communication apparatus of claim 15, wherein the electrical short determining circuit is further configured to identify an electrical short on the second communication channel by comparing a voltage level of the second communication channel with respect to a reference voltage level of the second communication channel.

17. The aviation communication apparatus of claim 15, wherein the first communication channel is a left communication channel of the stereo jack and the second communication channel is a right communication channel of the stereo jack.

18. The aviation communication apparatus of claim 15, wherein the voltage monitor monitors a voltage level across the first communication channel and a second communication channel.

19. The aviation communication apparatus of claim 18, wherein the electrical short determining circuit is further configured to identify an electrical short between the first communication channel and the second communication channel by comparing the monitored voltage level with respect to the reference voltage level across the first communication channel and the second communication channel.

20. A method of indicating an electrical short for an aviation communication apparatus, comprising:

providing a first voltage input, from a first voltage source, to a first communication channel of a stereo jack for a headset;

monitoring a voltage level of the first communication channel with respect to a reference voltage level of the first communication channel;

determining that an electrical short has occurred on the first communication channel based on the monitoring; and indicating on the aviation communication apparatus that an electrical short has occurred on the first communication channel.

21. The method of claim 20, further comprising monitoring a voltage level across the first communication channel and a second communication channel with respect to the reference voltage level.

22. The method of claim 21, further comprising determining that the headset coupled with the stereo jack is operating a mono setting by monitoring a voltage level across the first communication channel and second communication channel with respect to the reference voltage level.

* * * * *